US009964083B2

(12) United States Patent
Eklund et al.

(10) Patent No.: US 9,964,083 B2
(45) **Date of Patent: *May 8, 2018**

(54) FUEL INJECTION SYSTEM

(75) Inventors: Kjell Eklund, Vaasa (FI); Mikael Troberg, Trieste (IT); Anton Wintersteller, Trieste (IT); Vesa Voutilainen, Vaasa (FI)

(73) Assignee: WARTSILA FINLAND OY, Vaasa (FI)

( * ) Notice: Subject to any disclaimer, the term of this patent is extended or adjusted under 35 U.S.C. 154(b) by 382 days.

This patent is subject to a terminal disclaimer.

(21) Appl. No.: 13/984,828

(22) PCT Filed: Jan. 24, 2012

(86) PCT No.: PCT/FI2012/050059

§ 371 (c)(1),
(2), (4) Date: Sep. 13, 2013

(87) PCT Pub. No.: WO2012/107633

PCT Pub. Date: Aug. 16, 2012

(65) Prior Publication Data

US 2014/0000562 A1 Jan. 2, 2014

(30) Foreign Application Priority Data

Feb. 9, 2011 (FI) ..... 20115126

(51) Int. Cl.
*F02M 55/00* (2006.01)
*F02M 65/00* (2006.01)
(Continued)

(52) U.S. Cl.
CPC ..... *F02M 55/002* (2013.01); *F02M 37/0017* (2013.01); *F02M 37/0052* (2013.01);
(Continued)

(58) Field of Classification Search
CPC .... F02M 55/002; F02M 55/02; F02M 55/025; F02M 55/04; F02M 63/005;
(Continued)

(56) References Cited

U.S. PATENT DOCUMENTS 6,769,406 B2 * 8/2004 Ohta ..... F02M 55/00 123/447
6,827,065 B2 * 12/2004 Gottemoller ..... F02M 55/002 123/198 D
(Continued)

FOREIGN PATENT DOCUMENTS

DE 19712135 8/1998
DE 19842067 3/2000
(Continued)

*Primary Examiner* — Jacob Amick
*Assistant Examiner* — Michael A Kessler
(74) *Attorney, Agent, or Firm* — Muncy, Geissler, Olds & Lowe, P.C.

(57) ABSTRACT

A fuel injection system for a reciprocating engine, comprising injectors for injecting pressurized fuel into the cylinders of the engine, a high pressure pump for pressurizing fuel to be injected, a supply pipe for feeding fuel from the high pressure pump toward the injectors and feed pipes for feeding fuel from the supply pipe to the injectors. The first ends of the feed pipes are connected to the injectors and the second ends to the supply pipe. Each fuel injector is provided with a pressure accumulator.

10 Claims, 2 Drawing Sheets

(51) Int. Cl.

| | |
|---|---|
| ***F02M 55/02*** | (2006.01) |
| ***F02M 55/04*** | (2006.01) |
| ***F02M 63/02*** | (2006.01) |
| *F02M 37/00* | (2006.01) |
| *F02M 47/02* | (2006.01) |
| *F02M 63/00* | (2006.01) |

(52) U.S. Cl.

CPC ..... *F02M 55/005* (2013.01); *F02M 55/02* (2013.01); *F02M 55/025* (2013.01); *F02M 55/04* (2013.01); *F02M 63/025* (2013.01); *F02M 65/006* (2013.01); *F02M 37/0047* (2013.01); *F02M 47/027* (2013.01); *F02M 63/005* (2013.01); *F02M 63/0052* (2013.01); *F02M 2200/315* (2013.01); *F02M 2200/40* (2013.01); *F02M 2700/05* (2013.01)

(58) Field of Classification Search

CPC ..... F02M 2200/40; F02M 2200/315; F02M 65/006; F02M 2700/05; F02M 37/0017; F02M 37/0023; F02M 37/0047; F02M 37/0052; F02M 63/00; F02M 47/02; F02M 69/462; F02M 69/465; F02M 69/50; F02D 19/0684

USPC ..... 123/495, 447, 456, 461, 514, 468–469

See application file for complete search history.

(56) References Cited

U.S. PATENT DOCUMENTS

| | | | | |
|---|---|---|---|---|
| 9,506,436 | B2 * | 11/2016 | Voutilainen | F02M 55/002 |
| 2003/0094158 | A1 * | 5/2003 | Maier | F02D 19/0657 123/447 |
| 2004/0187848 | A1 * | 9/2004 | Hlousek | F02M 47/027 123/447 |
| 2014/0007844 | A1 * | 1/2014 | Voutilainen | F02M 55/002 123/446 |

FOREIGN PATENT DOCUMENTS

| | | | | |
|---|---|---|---|---|
| DE | 19931282 | | 1/2001 | |
| DE | 10114219 | | 9/2002 | |
| EP | 1150006 | A2 * | 10/2001 | F02M 55/002 |
| EP | 1314883 | | 5/2003 | |
| EP | 1612401 | | 1/2006 | |
| EP | 1612405 | | 1/2006 | |
| EP | 1612405 | A1 * | 1/2006 | F02M 47/027 |
| EP | 2011996 | | 1/2009 | |
| GB | 2013822 | | 8/1979 | |
| GB | 2310892 | | 9/1997 | |
| WO | WO03076794 | | 9/2003 | |
| WO | WO2007009279 | | 1/2007 | |
| WO | WO 2009147291 | A2 * | 12/2009 | F02M 55/002 |
| WO | WO2011060477 | | 5/2011 | |
| WO | WO 2014001637 | A1 * | 1/2014 | F02M 55/002 |

* cited by examiner

FUEL INJECTION SYSTEM

The invention relates to a fuel injection system for a reciprocating engine.

For improving operation of diesel engines a so-called common rail fuel injection system is commonly used. In the common rail system the pressure supply and the fuel injection are functionally separated from each other. Fuel is fed by means of high pressure pump into a common rail, from which it is led through separate pipes to the fuel injectors. This kind of common rail fuel injection systems are known from prior art, for example from EP 959 245 B1.

The object of the present invention is to provide an improved fuel injection system.

The object of the invention is achieved as disclosed in claim 1. The fuel injection system according to the invention comprises injectors for injecting pressurized fuel into the cylinders of the engine, a high pressure pump for pressurizing fuel to be injected, a supply pipe for feeding fuel from the high pressure pump toward the injectors and feed pipes for feeding fuel to the injectors. The first ends of the feed pipes are connected to the injectors and the second ends to the supply pipe. Further, each fuel injector is provided with a pressure accumulator.

Significant benefits can be achieved by means of the invention. The fuel injection system according to the invention is cost effective, since it does not comprise a separate pressure accumulator (common rail), from which fuel is fed into the feed pipes and the injectors. Further, the fuel injection system can be easily retrofitted to existing engines.

In the following the invention will be described by way of an example with reference to the accompanying schematic drawings, in which.

Figure 1:
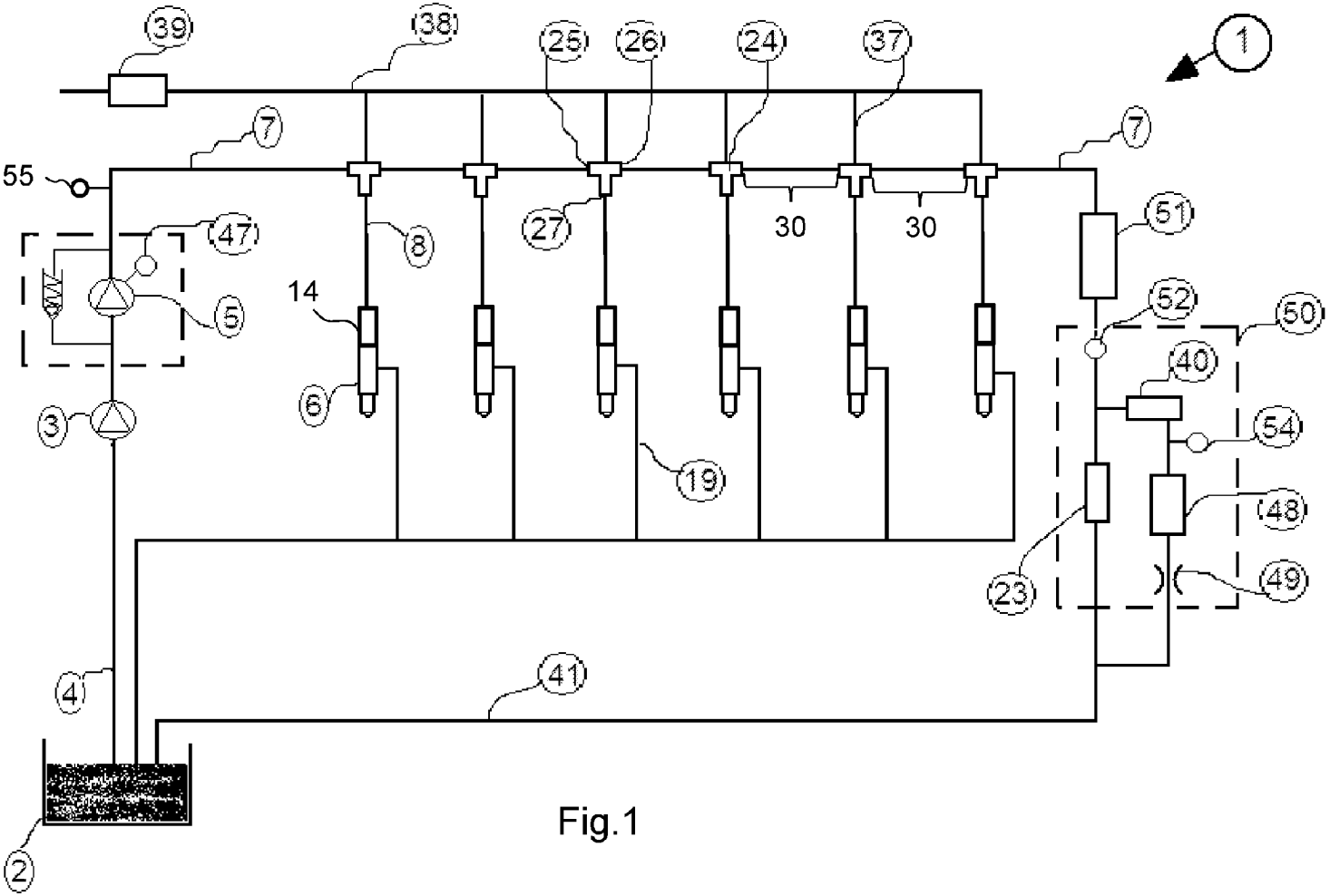
FIG. 1 shows a fuel injection system according to an embodiment of the present invention.

FIG. 1 shows schematically a fuel injection system 1 of a large reciprocating engine, for example of a large diesel engine. Cylinders of the engine can be arranged inline or in V configuration. Large reciprocating engine refers here to such engines that can be used for instance as main and auxiliary engines in ships or in power plants for production of heat and/or electricity. The engine can be operated by heavy fuel oil. The fuel injection system 1 comprises fuel injectors 6 for injecting fuel into the cylinders of the engine. Additionally, the fuel injection system 1 comprises a fuel source, for example a fuel tank 2, from which fuel is fed by means of a low pressure pump 3 along a fuel line 4 into a high pressure pump 5. The high pressure pump 5 elevates the fuel pressure to a level that a sufficient injection pressure may be obtained in the injectors 6. If the cylinders are arranged in V configuration, the fuel injection system 1 can comprise a common high pressure pump for both cylinder banks or each cylinder bank can be provided with a separate high pressure pump. The high pressure pump 5 is provided with a temperature sensor 47 for measuring fuel temperature.

The fuel injection system 1 comprises 1 a supply pipe 7 for feeding fuel from the high pressure pump 5 toward the fuel injectors 6. One end of the supply pipe 7 is connected to the high pressure pump 5. The supply pipe 7 is a double wall pipe, which comprises an inner flow space (56, FIG. 2) for feeding fuel toward the injectors 6 and an outer flow space (57, FIG. 2) for possibly leaking fuel. Fuel is fed from the high pressure pump 5 toward the injectors 6 through the inner flow space 56. The outer flow space 57 acts as a collecting channel for possibly leaking fuel. Each injector 6 is connected to the supply pipe 7 by means of a separate feed pipe 8. First end of the feed pipe 8 is connected to the injector 6. Second end of the feed pipe 8 is connected to the supply pipe 7. The second end of the feed pipe 8 can be connected to the supply pipe 7 by means of a connector 24. The supply pipe 7 can be provided with a pressure sensor 55, which is arranged to measure the fuel pressure in the inner flow space 56. The pressure sensor 55 can be installed between the high pressure pump 5 and the first pipe connector 24 in the fuel flow direction.

The double wall supply pipe 7 is provided with a circulation valve 23 for connecting the supply pipe 7 to the fuel tank 2. The circulation valve 23 enables the circulation of fuel in the injection system 1, for example for heating it before starting of the engine. Further, the double wall supply pipe 7 is provided with a safety valve 40, which protects the fuel injection system 1 against excess pressure. The safety valve 40 maintains the pressure in the supply pipe 7 below a predetermined maximum value. The safety valve 40 can also act as a pressure drop valve, by which the fuel injection system 1 can be depressurized. The outlet side of the safety valve 40 is provided with a discharge container 48 and a throttle 49, through which fuel discharged from the safety valve 40 flows. The throttle 49 is placed downstream of the discharge container 48. The discharge container 48 and the throttle 49 dampen the pressure pulsation of fuel. Further, the outlet side of the safety valve 40 is provided with a fuel temperature sensor 54 for measuring the fuel temperature so as to reveal possible fuel leaks from the safety valve 40. The circulation valve 23 and the safety valve 40 are connected to the fuel tank 2 through a return line 41. The circulation valve 23 and the safety valve 40 can be integrated into a single valve module 50. Additionally, the valve module 50 comprises the discharge container 48 and the throttle 49. The valve module 50 can also comprise the fuel temperature sensor 54. The circulation valve 23 and the safety valve 40 are connected to the double wall supply pipe 7 at a location downstream of the last pipe connector.

A high pressure volume 51 can be connected to inner flow space of the double wall supply pipe 7. The purpose of the high pressure volume 51 is to dampen fuel pressure pulsations in the inner flow space. The high pressure volume 51 can be connected to the double wall supply pipe at a location downstream of the last pipe connector 24. The valve module 50 can be provided with a fuel pressure sensor 52, which is arranged to measure fuel pressure in the inner flow space of the double wall supply pipe 7. The pressure measurements of the pressure sensor 55 and the fuel pressure sensor 52 are used in the control of the fuel pressure in the inner flow space. The fuel pressure in the inner flow space can be controlled on the basis of the higher pressure value measured by the sensors 52, 55.

The fuel injection system 1 is provided without a pressure accumulator (common rail), to which one or more feed pipes 8 are connected. A conventional common rail fuel injection system comprises a pressure accumulator into which fuel is fed from the high pressure pump and from which fuel is further fed into one or more injectors by feed pipes. The injection system shown in FIG. 1 does not comprise such a pressure accumulator i.e. a pressure accumulator to which one or more feed pipes 8 are connected. It is commonly known in the field of fuel injection that the pressure accumulator has to store a considerable volume of pressurized fuel i.e. fuel is accumulated in the pressure accumulator. Depending on the shape of the pressure accumulator, the cross sectional flow area of the pressure accumulator is typically considerably greater than that of fuel discharge pipes connected thereto. In the embodiment shown in the drawings, the cross sectional flow area of the supply pipe 7 (inner flow space) can be as great as or slightly greater than the cross sectional flow area of the feed pipes 8 connected thereto.

Figure 2:
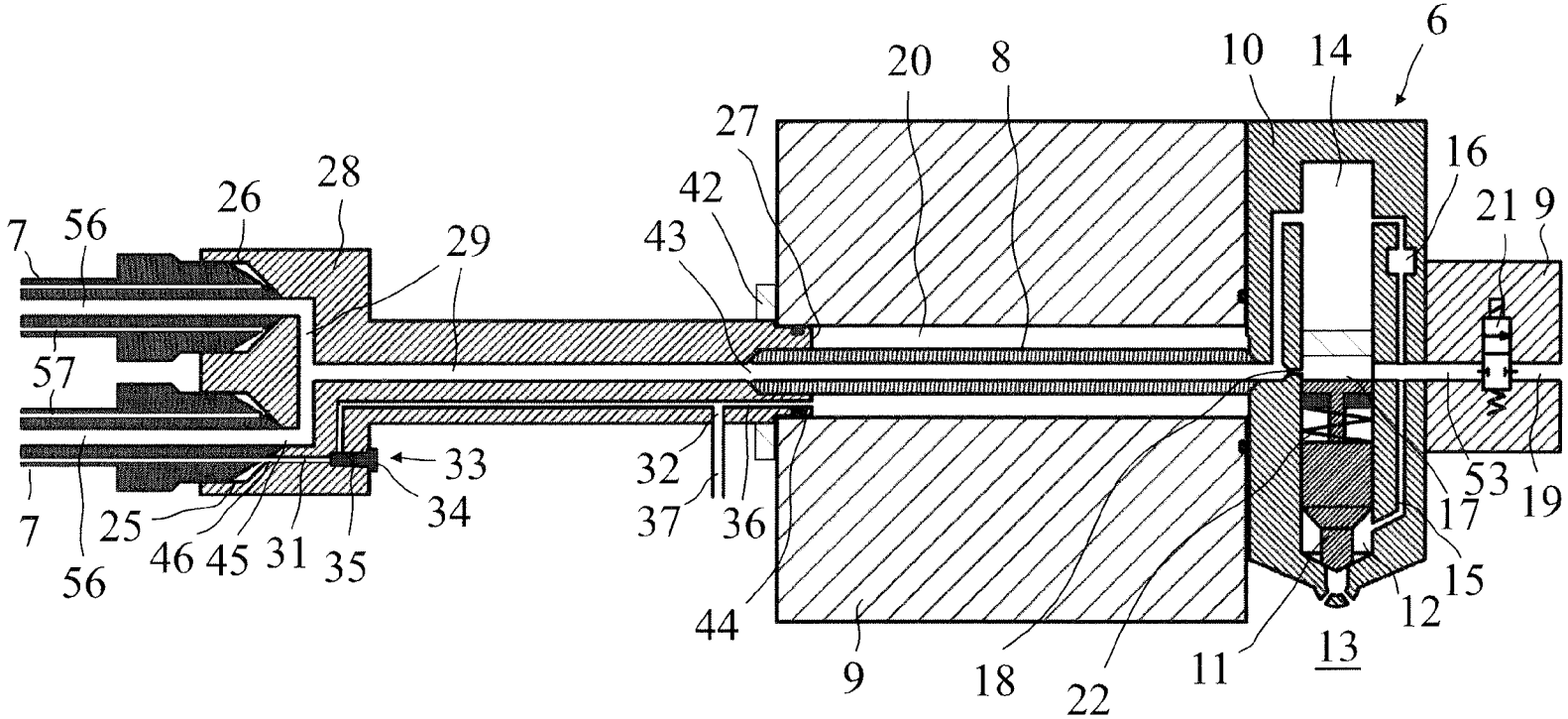
FIG. 2 is a cross sectional view of a fuel injector and a pipe connector that can be used in the fuel injection system of FIG. 1.

The basic construction of the fuel injector 6 is shown in more detail in FIG. 2. The fuel injectors 6 are mounted on the cylinder head 9 of the engine. The cylinder head 9 comprises a bore 20 in which the feed pipe 8 is arranged. The fuel injector 6 comprises an injector body 10, in which a fuel chamber 12 and a valve needle 11 are arranged. The valve needle 11 controls fuel injection from a fuel chamber 12 into the engine cylinder 13. Depending on the position of the valve needle 11, the fuel injection from the fuel chamber 12 into the cylinder 13 is either allowed or prevented. The injector 6 comprises a pressure accumulator 14 for fuel. The pressure accumulator 14 is an integral part of the injector 6. The pressure accumulator 14 can be arranged in the injector body 10. The volume of the pressure accumulator 14 is at least 40, typically 50 to 70 times the amount (volume) of fuel injected by the injector 6 during one injection event at full (100%) engine load.

The pressure accumulator 14 is in flow connection with the fuel chamber 12 via a connecting channel 15. A flow fuse 16 is arranged in the connecting channel 15. The flow fuse 16 prevents the fuel flow from the injector pressure accumulator 14 to the fuel chamber 12 in case of malfunction of the injector 6, for example when the valve needle 11 fails to close properly.

The injector 6 comprises a control chamber 17 into which fuel is fed through the feed pipe 8. An inlet of the control chamber 17 is provided with a throttle 18 by which the fuel flow into the control chamber 17 can be restricted. The fuel pressure in the control chamber 17 acts on the valve needle 11. The force caused by the fuel pressure in the control chamber 17 urges the valve needle 11 toward the closed position. The movement of the valve needle 11 and thus the fuel injection into the cylinder 13 can be controlled by adjusting fuel pressure in the control chamber 17. A return line 19 for removing fuel from the control chamber 17 is connected to the injector 6. The return line 19 is arranged in or connected to a second bore 53 in the cylinder head 9. A control valve 21 is arranged in the return pipe 19 for controlling the discharge of fuel from the control chamber 17. The control valve 21 can be a solenoid valve. The injector 6 is also provided with a spring 22 which urges the valve needle 11 toward the closed position.

To initiate the fuel injection the control valve 21 is opened. Fuel flows from the control chamber 17 into return line 19 and the fuel pressure in the control chamber 17 decreases. Fuel flows through the second bore 53 and the return line 21 into the fuel tank 2. When the pressure in the control chamber 17 is low enough, the force caused by the fuel pressure in the fuel chamber 17 urges the valve needle 11 toward the open position against the force of spring 22. As a result, the valve needle 11 is lifted from its seat and fuel is injected from the fuel chamber 12 into the cylinder 13. When the control valve 21 is closed, fuel pressure in the control chamber 17 increases. Consequently, the valve needle 11 returns to its closed position against the seat so that fuel injection from the fuel chamber 12 into cylinder 13 stops.

FIG. 2 shows a pipe connector 24 for connecting the double wall supply pipe 7 to the feed pipe 8. The pipe connector 24 can be a T-connector. The pipe connector 24 comprises three fittings 25-27. A first fitting 25 comprises a first portion 45 connected to the inner flow space and a second portion 46 connected to the outer flow space of the double wall supply pipe. A second fitting 26 is connected to the inner flow space of the double wall supply pipe 7. A third fitting 27 comprises a first portion 43 and a second portion 44. The first portion 43 is connected to the feed pipe 8.

The pipe connector 24 comprises a connector body 28, in which a flow channel 29 is arranged for interconnecting the first portion 45 of the first fitting, the second fitting 26 and the first portion 43 of the third fitting. A leak channel 31 is arranged in the connector body 28. The leak channel 31 is in flow connection with the outer flow channel of the supply pipe 7 through the second portion 46 of the first fitting.

The outer flow space 57 of the supply pipe 7, which is connected to the second fitting 26, is fluidly separated from the leak channel 31 and the outer flow space of the supply pipe 7 connected to the first fitting 25. Thus, the pipe connectors 24 divide the outer flow space 57 of the supply pipe 7 into compartments 30 (FIG. 1), which are fluidly separated from each other. The leak channel 31 is in flow connection with only one compartment 30 of the outer flow space 57.

The pipe connector 24 comprises a leakage outlet 32 for discharging fuel from the leak channel 31. The connector 24 is provided with a leak detector 33 for detecting fuel leaking into the outer flow space of the supply pipe 7, and flowing therefrom into the flow channel 31. The leak detector 33 comprises a closure member, such as a pin 34, which extends into the leak channel 31. The pin 34 has a first position, in which flow from the leak channel 31 to the leakage outlet 32 is prevented, and a second position, in which flow from the leak channel 31 to the leakage outlet 32 is allowed. In the first position the pin 34 blocks the leak channel 31 and thus prevents fuel from flowing from the leak channel 31 to the leakage outlet 32. In the second position the pin 34 uncovers the leak channel 31 so that a flow connection exists between the leak channel 31 and the leakage outlet 32.

FIG. 2 shows a normal situation in which there is no leak and the pin 34 is in the first position in the connector body 28. When the pin 34 is in the first position, there is no flow connection between the leak channel 31 and the leakage outlet 32. If leaking fuel flows to the leak channel 31, the pressure in the leak channel begins to rise. As the pressure in the leak channel 31 rises above a certain level, the pin 34 begins to move outwards from the connector body 28, until the second position is reached. In the second position fuel flows from the leak channel 31 to the leakage outlet 32. The pin 34 is provided with a holding member for keeping the pin in the first position as the pressure in the leak channel is low. The holding member comprises rings 35 made of rubber or other suitable material and arranged around the outer surface of the pin 34. The rings 35 are against the inner surface of the leak channel 31. The pressure, at which the pin 34 begins to move from the first position towards the second position, can be set by proper design of the rings 35. In the second position the pin 34 protrudes from the connector body 28. The second position of the pin 34 can be detected from outside the connector 24. Because the leak channel 31 is in flow connection with only one compartment 30 of the outer flow space 57, the pin 31 also indicates the supply pipe section in which leak occurs.

The pipe connector 24 comprises a discharge channel 36, which extends from the second portion 44 of the third fitting to the leakage outlet 32 and provides a continuous flow connection therebetween. The feed pipe 8 is arranged in the bore 20 in the cylinder head 9. The pipe connector 24 is connected to the cylinder head 9 so that the bore 20 opening surrounds the third fitting 27 and the discharge channel opening. The connector 24 comprises a mounting bracket 42, by means of which it can be attached to the cylinder head 9. A clearance between the outer surface of the feed pipe 8 and the inner surface of the bore 20 acts as a drain channel for fuel leaking from the injector 6. The bore 20 is in flow connection with the leakage outlet 32 through the discharge channel 36. Thus, fuel leaking from the injector 6 and/or the feed pipe 8 can be drained through the leakage outlet 32.

A discharge line 37 is connected to the leakage outlet 32. The discharge lines 37 from the connectors are connected to a common collecting line 38. Leaking fuel flow from the discharge lines 37 is led to the collecting line 38. The collecting line 38 is provided with a leak detection device 39. The leak detection device 39 is connected to the collecting line 38 to a location through which all fuel from the discharge lines 37 flows. Because in normal operating conditions of the injectors 6 only a small amount of fuel leaks from the injectors 6, it is favorable that only larger flows of leaking fuel are detected. Therefore, the leak detection device 39 is arranged to detect only fuel flows having a flow rate over a predetermined value. When the predetermined flow rate is exceeded, the leak detection device 39 is arranged to trigger an alarm or otherwise indicate that there is a fuel leak from the injector 6 or the double wall supply pipe 7. If the leak detection device indicates a leak and all the pins 34 are in the first position, fuel leaks from the injector 6 and/or feed pipe 8. Correspondingly, if at least one of the pins 34 is in second position, fuel leaks from the double wall supply pipe 7. The pin 34 also indicates the supply pipe section, in which the leak occurs.

The invention claimed is:

1. A fuel injection system for a reciprocating engine, comprising:

injectors for injecting pressurized fuel into cylinders of the engine, a high pressure pump for pressurizing fuel to be injected, a supply pipe for feeding fuel from the high pressure pump toward the injectors, feed pipes for feeding fuel from the supply pipe to the injectors, and connectors for connecting the feed pipes to the supply pipe, each connector comprising a first fitting, a second fitting, a third fitting and a leak channel, wherein first ends of the feed pipes are connected to the injectors, second ends of the feed pipes are connected to the supply pipe by means of the connectors, and each fuel injector is provided with a pressure accumulator, which is an integral part of the injector, wherein the supply pipe is a double wall pipe, which comprises an inner flow space for feeding fuel toward the injectors and an outer flow space for possibly leaking fuel, and the first fitting of each connector is connected to the inner flow space and to the outer flow space of the supply pipe, the second fitting is connected to the inner flow space of the supply pipe, and the third fitting is connected to a feed pipe, the connector dividing the outer flow space of the supply pipe into compartments, which are fluidly separated from each other, the leak channel being in flow connection with only that compartment of the outer flow space of the supply pipe, which is connected to the first fitting, each connector being provided with its own individual leak detector for detecting fuel leaks from the supply pipe into the leak channel, wherein the connector comprises a connector body, in which a flow channel is arranged for interconnecting the first fitting, the second fitting and the third fitting, wherein the leak channel is arranged in the connector body, wherein a discharge channel extending from the third fitting to a leakage outlet is arranged in the connector body and the connector body is connectable to a cylinder head so that a bore of the cylinder head surrounds an opening of the discharge channel and the discharge channel provides a continuous flow connection between the third fitting and the leakage outlet for draining fuel leaking from the injector and/or from the feed pipe, and wherein the leak detector has a first position, in which flow from the leak channel to the discharge channel is prevented and a second position, in which flow from the leak channel to the discharge channel and further to the leakage outlet is allowed, and the leak detector is arranged to move from the first position to the second position when pressure in the leak channel rises above a certain level.

2. The fuel injection system according to claim 1, wherein a volume of the pressure accumulator is at least 40 times the amount of fuel injected by the injector during one injection event at full (100%) engine load.

3. The fuel injection system according to claim 2, wherein a volume of the pressure accumulator is 50-70 times the amount of fuel injected by the injector during one injection event at full (100%) engine load.

4. The fuel injection system according to claim 1, wherein the supply pipe is provided with a circulation valve for connecting the supply pipe to a fuel tank.

5. The fuel injection system according to claim 4, wherein the supply pipe is provided with a safety valve for maintaining the pressure in the supply pipe below a predetermined maximum value and for depressurizing the supply pipe.

6. The fuel injection system according to claim 5, wherein the circulation valve and the safety valve are integrated into a single valve module.

7. The fuel injection system according to claim 1, wherein the connector comprises a leak channel being in flow connection with the outer flow space of the supply pipe, a leakage outlet for draining fuel from the leak channel, and a closure member having a first position, in which flow from the leak channel to the leakage outlet is prevented, and a second position, in which flow from the leak channel to the leakage outlet is allowed, and that the closure member is arranged to move from the first position to the second position when the pressure in the leak channel rises above a certain limit.

8. The fuel injection system according to claim 7, wherein the position of the closure member can be detected from outside the connector.

9. The fuel injection system according to claim 7, wherein the connectors divide the outer flow channel into compartments, and that the leak channel of each connector is in flow connection with only one compartment.

10. The fuel injection system according to claim 5, wherein an outlet side of the safety valve is provided with a discharge container and a throttle.

* * * * *